United States Patent [19]

Bravo

[11] Patent Number: 5,058,854

[45] Date of Patent: Oct. 22, 1991

[54] CONTAINMENT BOX INSTALLATION TOOL

[76] Inventor: Sergio M. Bravo, 2872 Tigertail Dr., Los Alamitos, Calif. 90720

[21] Appl. No.: 481,497

[22] Filed: Feb. 16, 1990

[51] Int. Cl.[5] ..... E01C 19/50

[52] U.S. Cl. ..... 249/2; 249/5; 249/93; 249/219.1

[58] Field of Search ..... 249/4, 5, 8, 91, 93, 249/219.1, 2

[56] References Cited

U.S. PATENT DOCUMENTS

| | | | |
|---|---|---|---|
| 1,036,697 | 8/1912 | Percival | 249/93 X |
| 1,363,391 | 12/1920 | Carpenter | 249/29 |
| 1,397,253 | 11/1921 | Jones | 249/8 X |
| 1,408,301 | 2/1922 | Jeter | 249/219.1 |
| 1,885,699 | 11/1932 | Feldblet | 249/25 |
| 2,094,538 | 9/1937 | Ingersoll | 249/93 X |
| 2,711,573 | 6/1955 | Bliss | 249/219.1 X |
| 2,908,959 | 10/1959 | Hogan et al. | 249/208 |
| 3,163,909 | 1/1965 | Williams | 249/93 X |
| 3,207,465 | 9/1963 | Papin | 249/5 X |
| 3,277,556 | 8/1963 | Platt et al. | 52/677 X |
| 3,288,426 | 6/1964 | Simpson | 249/5 X |
| 3,376,010 | 5/1965 | Myer | 249/8 X |
| 3,422,585 | 7/1967 | Dismukes | 249/5 X |
| 3,578,309 | 5/1971 | Freedman | 249/219.2 X |
| 3,592,437 | 7/1971 | Dashere | 249/175 |
| 3,614,052 | 10/1971 | Babbage | 249/23 |
| 3,647,173 | 3/1972 | Pipala | 249/31 |
| 3,648,961 | 3/1972 | Farrow | 249/43 |
| 3,847,339 | 11/1974 | Farrell | 249/93 X |
| 4,123,031 | 10/1978 | Hyre | 249/24 |
| 4,261,544 | 4/1981 | Addison | 249/93 X |
| 4,339,106 | 7/1982 | Navarro | 249/219.1 |
| 4,593,880 | 6/1986 | Smith et al. | 425/117 X |
| 4,736,554 | 4/1988 | Tyler | 249/93 X |
| 4,811,927 | 3/1989 | Slonimsky et al. | 249/219.1 X |
| 4,842,163 | 6/1989 | Bravo | 222/40 |
| 4,931,235 | 6/1990 | Lindquist et al. | 249/93 X |

FOREIGN PATENT DOCUMENTS

| | | | |
|---|---|---|---|
| 538666 | 12/1955 | Belgium | 249/93 |
| 1145179 | 4/1983 | Canada | 249/219.1 |
| 554379 | 4/1977 | U.S.S.R. | 249/219.1 |

*Primary Examiner*—Jay H. Woo
*Assistant Examiner*—Robert B. Davis
*Attorney, Agent, or Firm*—Christie, Parker & Hale

[57] ABSTRACT

A tool for installing an object for example a flammable fluids containment box in a form for a concrete structure has an elongated bar oriented horizontally, and four slidable assemblies mounted on it. Two outer assemblies each have a horizontal rod section around the bar and a T-screw or allen head bolt for fastening the rod section in place on the bar. The outer assemblies have a mechanism to engage a lip of the form, and a mechanism to support the assembly on the ground outside the form if the form is lipless. The inner assemblies each have a horizontal rod section that fastens in place on the horizontal rod, and has a vertical rod attached to its underside. At the bottom of the vertical rod is an assembly for fastening the containment box such that the tool thus suspends the containment box in position in the form, so that the box will set in place in the concrete.

4 Claims, 3 Drawing Sheets

CONTAINMENT BOX INSTALLATION TOOL

BACKGROUND OF THE INVENTION

The present invention relates to a tool for and a method of installing a box or other article in a larger structure, such as installing a gasoline or flammable fluids containment box in position in a form for a concrete structure.

In recent years there has been enhanced concern for the environment and for safety, especially in the handling of gasoline and other flammable materials and pollutants. One outgrowth of this concern is a containment box for installation in a concrete island directly below a gasoline dispenser to collect any leaking gasoline. Such a containment box is disclosed in U.S. Pat. No. 4,842,163, filed in the name of the present inventor.

Proper installation of a box or other object in a concrete island can be difficult. In a typical installation process, in order to position the box in a concrete island, the island form is placed in an area excavated for the island. Then, a smaller form representing the box is positioned within the island form. After the concrete is poured and set, the smaller form is removed, leaving a space for the containment box. The size and position of the form representing the box is critical, in as much as the containment box must fit in the space left by the form. If the space left is too small or too large for the containment box, installation is cumbersome.

Accordingly, there is a need for a simpler, more efficient and accurate way to install a containment box in a concrete island.

SUMMARY OF THE INVENTION

The invention is a tool for and method of installing a box or other object (such as a containment box for gasoline or other hazardous or flammable fluids) in position in a form such as for a concrete island. The tool suspends the box in position in the form, preferably using the form for support, so that the concrete is laid with the box in place.

In one embodiment, the tool has a horizontal, elongated supporting rod or bar, with two outer slidable support assemblies, and two inner slidable container holding assemblies. The support assemblies each have a horizontal rod section slidably mounted on the supporting bar, the rod section having a downwardly extending rod. At the base of the downwardly extending rod there is a mechanism for mounting to the lip of an island form or for resting on the ground or other stable structure, to vertically support the horizontal bar above the island form. The box holding assemblies also each have a rod section slidably mounted on the supporting bar, the rod section having a downwardly extending rod. At the base of the downwardly extending rod is a mechanism for fastening the containment box to suspend the box in position in the form.

In a preferred embodiment, the horizontal supporting bar is hollow and rectangular in cross-section. The outer and inner assemblies each mount on the bar by means of a hollow rectangular rod section with dimensions slightly larger than those of the horizontal bar. Each rod section fastens in position on the horizontal bar by means of a T-screw or allen head bolt. Each inner and outer assembly has a vertically oriented hollow rectangular rod welded to the underside of the horizontal rod section. A piece of angle iron is welded to the bottom of each vertical rod of the outer assemblies to engage the lip of an end wall of the form. There is also a cylindrical tube welded to each vertically oriented rod so that a cylindrical rod having a foot can feed through the tube and support the tool on the ground. There is a T-screw or allen head bolt threaded through the side of the tube for clamping the cylindrical rod at a desired height.

The fastener of each inner assembly mounts on one leg of an angle iron. The other leg of the angle iron is welded to the bottom of the vertical rod. A large bolt threads through a large nut welded to the one leg of the angle iron. The large bolt has an axial bore through it for slidably receiving a long thin bolt. The threaded end of the thin bolt passes through a hole in a lip of the containment box and fastens to the lip by a small nut and washer to vertically support the box. The height of the box is adjustable by changing the threaded position of the large bolt or by holding the thin bolt or small nut while turning the other.

In a further embodiment, the angle iron is replaced by a thick (e.g., one inch) metal plate welded to the bottom of the vertical rod and having a hole through it for receiving the large bolt. Welded to the underside of the thick plate is a thin plate having a central hole aligned with that in the thick plate for receiving the large bolt. As in the previous embodiment a long thin bolt passes through an axial hole in the large bolt and a hole in the lip in the containment box, and fastens to the lip by a washer and a small nut. The thin plate has two additional holes, located on either side of the central hole, and two nuts respectively welded above the two holes. Bolts or screws thread through these nuts and contact the lip of the containment box to provide side-to-side stability.

These and additional aspects of the invention will be better understood upon reading the detailed description and claims in conjunction with the drawings.

DETAILED DESCRIPTION OF THE PREFERRED EMBODIMENTS

The invention is a tool for and a method of installing a box or other object (such as a containment box for collecting gasoline or other hazardous or flammable fluids) in a concrete island. The tool suspends the box in position in the form, preferably using the form for support, so that the concrete is laid with the box or object in place.

Figure 1:
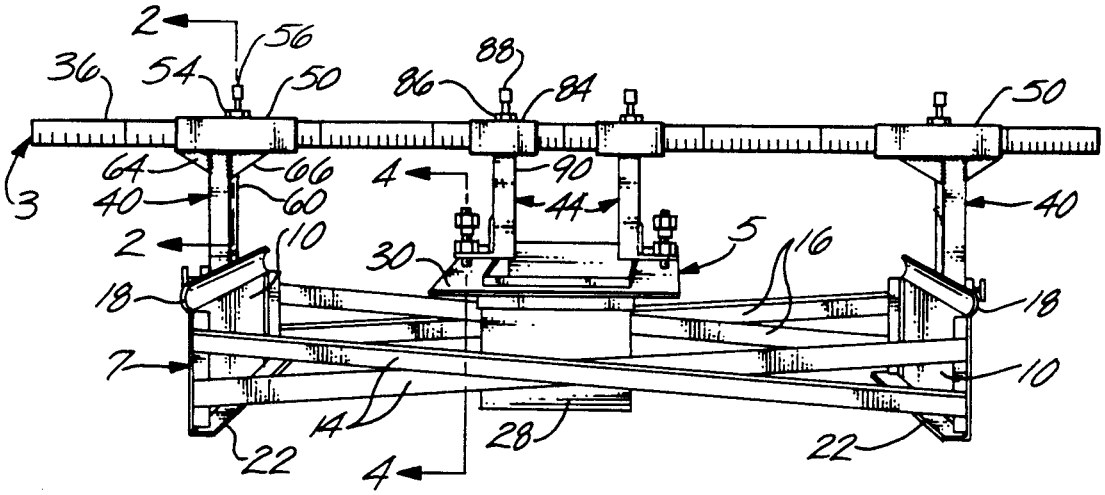
FIG. 1 is a side view of a first embodiment of an inventive installation tool for holding a containment box in position with respect to a cross sectioned form for a concrete island.

FIG. 1 is a side view of a first embodiment of an installation tool 3 according to the invention, showing the tool supporting a containment box 5 in position with respect to a cross section of an island form 7. Form 7 fits in an area excavated for the island. Form 7 has two side walls 10, 10 connected by two pairs of cross braces 14, 16. The side walls have lips 18, 18 and supporting feet 22, 22. Appropriate end walls (e.g., semicircular walls connecting each end of the side walls to create the familiar oval island shape) are well known in the art. While the form is illustrated with the braces 14, 16, in practice such braces may not be necessary.

Box 5 has a gasoline or pollutant collecting tank 28 with an open top and a rectangular lip 30. One example of a suitable containment box is disclosed in U.S. Pat. No. 4,842,163 which is incorporated herein by this reference. Tool 3 has an elongated horizontal support rod or bar 36 preferably made of a hollow rectangular or square rod of metal such as square tubing construction steel. Support bar 36 carries two outer support assemblies 40, 40 for vertically supporting the bar and two inner assemblies 44, 44 for holding the containment box. The bar has gradations along one side (or both sides) to aid in positioning the outer and inner assemblies.

Figure 2:
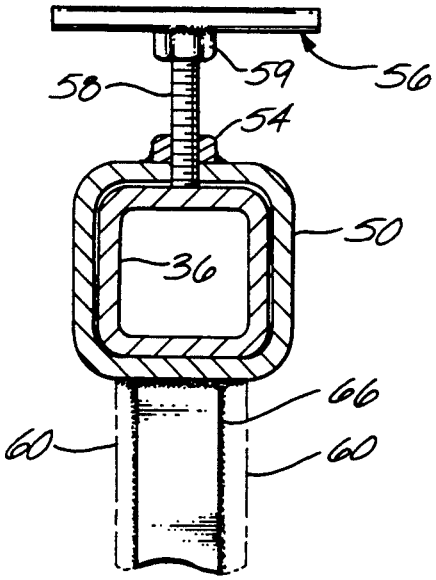
FIG. 2 is an enlarged partial sectional view, taken along line 2—2 of FIG. 1, of a top portion of one slidable outer assembly for supporting a horizontal support bar of the tool of FIG. 1.

Outer assemblies 40, 40 are preferably identically formed. Each outer assembly slidably attaches to bar 36 by means of a hollow rectangular or square short rod section 50. As best shown in FIG. 2, which is an enlarged cross sectional view taken along line 2—2 of FIG. 1, each rod section 50 has a hole and a nut 54 welded directly above the hole for threadedly engaging with a T-screw 56 having a threaded plug 58. To hold assembly 40 in position with respect to horizontal bar 36, the bottom of plug 58 engages bar 36. Loosening T-screw 56 allows assembly 40 to slide on bar 36. T-screw 56 is reinforced by a nut 59 welded on the plug 58 against the cross member of the T.

The gradations on bar 36 are preferably positioned along a side of the bar other than the side engaged by plugs 58 so that the gradations will not be obliterated by rubbing or scratching. The gradations may also be positioned within a recess extending along the side of the bar so as not to be worn off by movement of the rod sections.

Figure 3:
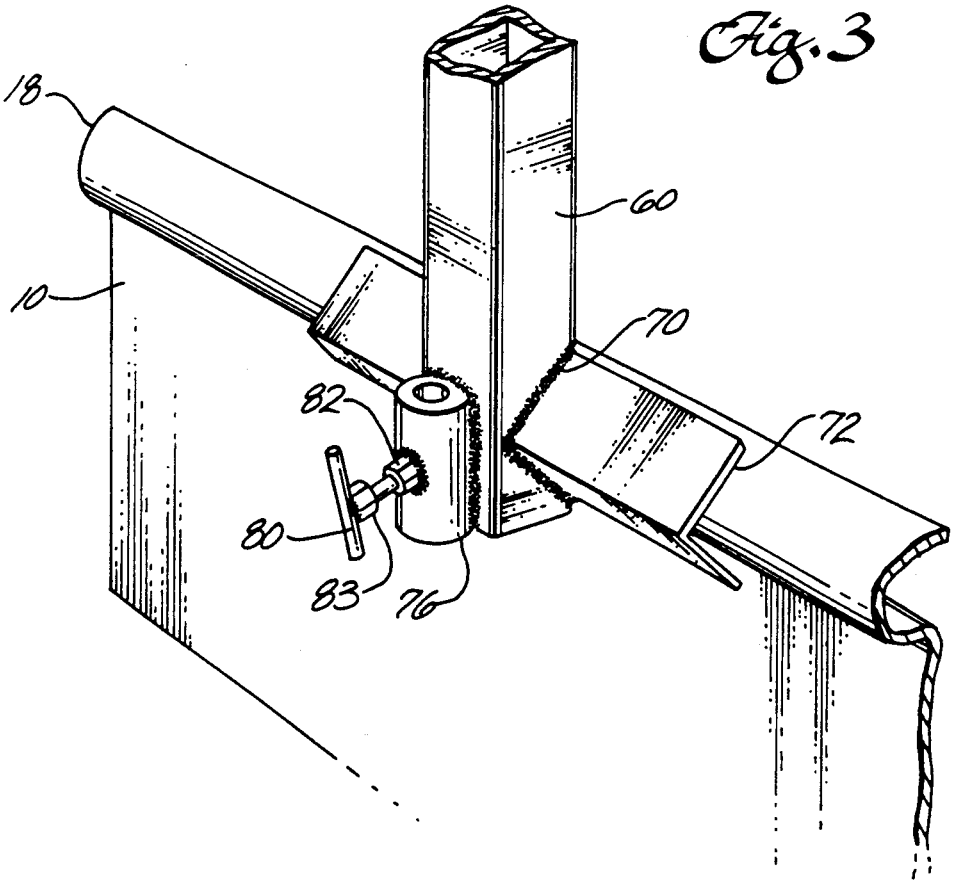
FIG. 3 is an enlarged perspective view of a lower portion of the outer assembly of the tool of FIG. 1 showing how the lower portion mounts on a lip of the island form.

A vertical hollow rectangular or square rod 60 welds to the bottom of rod section 50, extra support being supplied by two gussets 64, 66, if necessary. At the bottom of this vertical rod, there is a clamping assembly which is best shown in the enlarged perspective view of FIG. 3. The bottom of vertical rod 60 has a recess 70 for receiving an angle iron 72 welded into it. Where concrete form 7 has a lip 18, angle iron 72 supports outer assembly 40 on the lip.

Just in case the concrete form does not have a lip, the clamping assembly has a hollow cylindrical tube 76 for slidably receiving a cylindrical rod (not shown in this embodiment) having a foot (e.g., a piece of angle iron) welded to it. The foot rests on the ground or other stable surface. The cylindrical rod supports assembly 40 at the proper height by tightening another T-screw 80 received in a nut 82 welded to the side of tube 76 in line with a hole in the tube. T-screw 80 is shown reinforced with a nut 83 welded around its plug and to the cross member of the T.

Both inner assemblies 44, 44 are constructed the same. The upper portion of each of the inner assemblies is substantially the same as the upper portion of each outer assembly. Each inner assembly 44 has a rectangular or square rod section 84 slidably mounted on support bar 36. Rod section 84 has a hole with a nut 86 welded above it for receiving a T-screw 88. The bottom of rod section 84 has a vertical rectangular or square rod 90 welded to it.

Preferably, the upper portion of each inner assembly 44 differs from that of each outer assembly 40 in that rod section 84 is shorter than rod section 50, there are no gussets, and vertical rod 90 is centered with respect to the length of rod section 84. These changes stem from the fact that each inner assembly 44 only carries box 5 and is in tension, while each outer assembly 40 is in compression and supports itself plus support bar 36, the inner assemblies and box 5. Therefore, the inner assemblies can be constructed to be lighter in weight.

Figure 4:
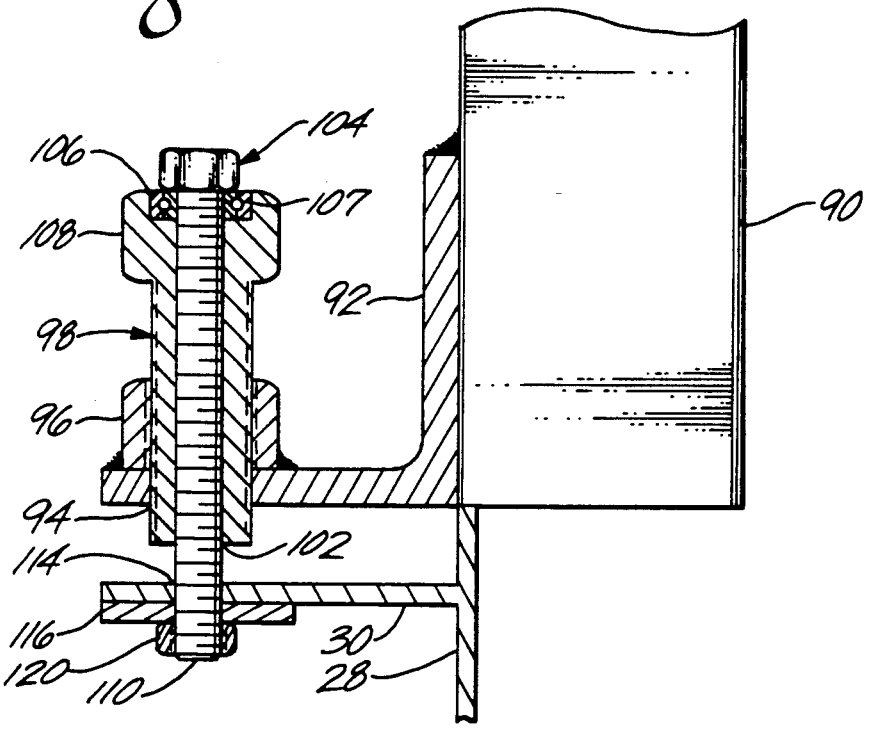
FIG. 4 is an enlarged sectional view, taken along line 4—4 of FIG. of a bottom portion of an inner assembly mounted to the horizontal support bar.

The lower portion of one inner assembly 44 is shown in FIG. 4, an enlarged cross sectional view taken along line 4—4 of FIG. 1. This lower portion functions as a containment box fastener, i.e., it holds box 5 in position. To support the fastener, an angle iron 92 has its vertical leg welded to rod 90. The horizontal leg of angle iron 92 has a hole 94 with a large nut 96 welded above it. A large bolt 98 threads through large nut 96. Large bolt 98 has an axial bore 102 for slidably receiving a long thin bolt 104.

The head of thin bolt 104 rests on an annular bearing 106 supported in an annular recess 107 in a head 108 of large bolt 98. Thin bolt 104 has a threaded end 110 which passes through a hole 114 in lip 30 of box 5, then through a washer 116 and a small nut 120 threaded to end 110. With this construction, the height of box 5 is adjusted by threading large bolt 98 in large nut 96. Thin bolt 104 primarily holds box 5 on rod 90 but the position of small nut 120 on end 110 could also be used to adjust the height of box 5. To change the position of small nut 120, either the head of thin bolt 104 or the small nut 120 must be held steady while the other is turned. The large bolt 98 and/or thin bolt 104 can serve not only to adjust the height of the box, but also to adjust the level of the box in the longitudinal direction of the horizontal bar regardless of the level of the form or bar.

Figure 5:
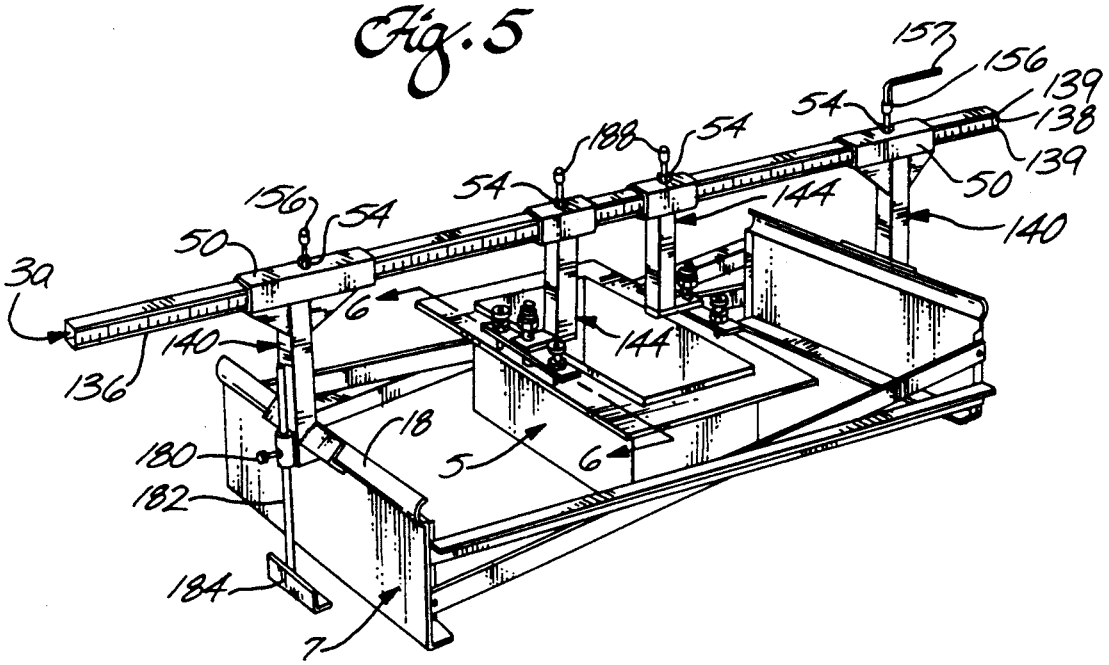
FIG. 5 is a perspective view of a second embodiment of the inventive installation tool.
Figure 6:
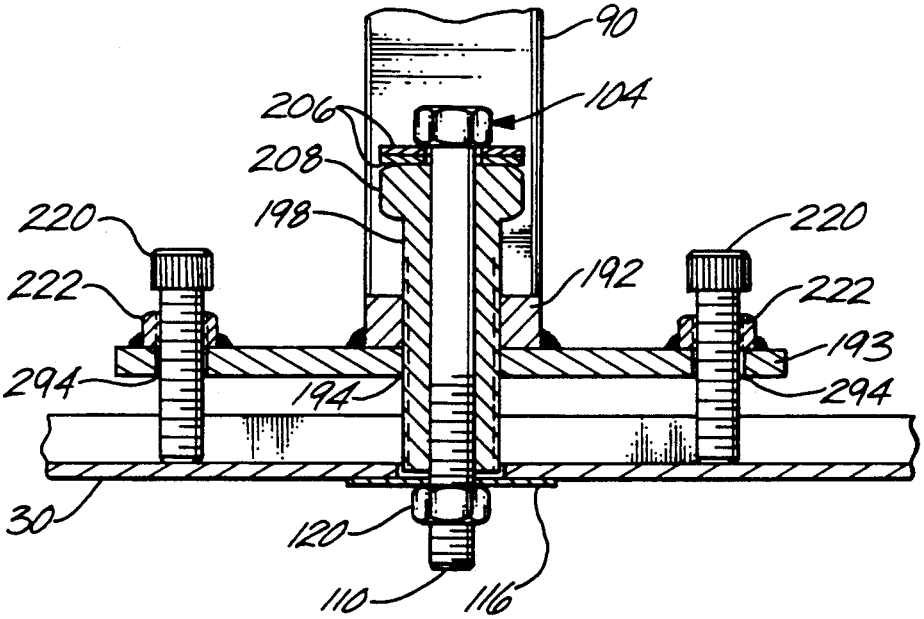
FIG. 6 is an enlarged sectional view, taken along line 6—6 of FIG. 5, of a bottom portion of an inner assembly mounted to the horizontal support bar.

FIG. 5 is a perspective view of a second embodiment of the invention, and FIG. 6 is an enlarged sectional view, taken along line 6—6 of FIG. 5, of a fastener of an inner assembly according to the second embodiment. Elements which are the same as those in the first embodiment are given the same reference numbers in the second embodiment.

Installation tool 3*a* has a horizontal bar 136 which is the same as bar 36 except that the gradations are on a plastic strip 138 inset into parallel grooves 139, 139 in the side of the bar. Insetting the gradations is preferred to avoid wear.

Each outer assembly 140 slidably mounts on bar 136 the same as in FIG. 1, except that bolts 156 have allen heads (rather than T-screws) which are loosened and tightened by an allen wrench 157 (shown only for purposes of illustration). Even though T-screws are easier to use, the allen head bolts are preferred to minimize the likelihood of tampering with the tool, as the wrench is needed to modify the position of the tool. For example, at a job site, it is desirable to set up the form one day, then pour the concrete the next day. Even when the concrete is poured on the same day as the form is set up, the concrete requires some time to set. Therefore, the form and tool are often vulnerable to tampering at night or any other time when the job site is left unattended.

The lower portion of each outer assembly is the same as the outer assemblies of FIG. 1, except that each bolt (bolt 180 for assembly 140) in cylindrical tube 76 has an allen head. FIG. 5 further shows an example of a suitable cylindrical rod 182 in tube 76. The cylindrical rod has a foot 184 of angle iron for supporting outer assembly 140 in cases where form 7 does not have a lip 18. This cylindrical rod 182 and angle iron 184 are illustrative and not exhaustive of the ways in which assembly 140 can be supported when form 7 is lipless.

In this second embodiment, the inner assemblies 144, 144 are modified at their upper portions with allen head bolts 188 instead of T-screws. The fasteners in assemblies 144 are modified to stabilize box 5 against lateral motion and swinging about bar 136, and to allow adjustment of the tilt of box 5 in the lateral direction with respect to the bar. These and other modifications are discussed in further detail below with specific reference to FIG. 6.

Vertical rod 90 has a thick (e.g., one inch) plate 192 welded to its bottom for mounting the fastener. Thick plate 192 has a thin plate 193 welded to it. Thin plate 193 has three holes, i.e., a central hole 194 and two outside holes 294. The central hole extends through thick plate 192 and receives a large bolt 198. Preferably, the central hole in the plates have threads so that large bolt 198 is vertically adjustable. As in the first embodiment, large bolt 198 has an axial bore for slidably receiving long thin bolt 104, the head of which rests on two washers 206. The washers in turn rest on large bolt head 208 and function substantially the same manner as bearing 106 in the first embodiment. Threaded end 110 of thin bolt 104 passes through containment box lip 30, washer 116 and small nut 120 for vertically supporting containment box 5.

To provide side-to-side stability of box 5, the fastener has two screws or allen head bolts 220 threaded through two nuts 222. These nuts are welded to thin plate 193 over the two outside holes 294, respectively. The bottoms of bolts 220 contact lip 30 to provide stability, and to allow tilt adjustment of box 5. The large bolt and/or thin bolt together with the bolts 220 can serve not only to adjust height of the box and provide tilt stability, but also to set the box to the desired level in both the longitudinal and transverse direction of the bar 136, regardless of the level of the bar or form.

The inventive tool simplifies containment box installation by eliminating the need for a form for the containment box and streamlining the previous multi-step process of laying the concrete, removing the form representing the box, then installing the box. In addition, it ensures that the box will fit in the island and that the level of the box can be adjusted as desired. The installation process using the inventive tool of the first embodiment as an example (references to the second embodiment are provided parenthetically) takes place as follows:

1. Set up form 7.

2. Position outer assemblies 40, 40 (140, 140) by sliding them along bar 36 (136) until the clamping assemblies engage lip 18 of form 7, then tighten the outer assemblies in position using T-screws 56, 56 (allen head bolts 156, 156). If the form is lipless, slide a cylindrical rod with a foot into each cylinder 76, and when the horizontal support rod is at the proper height to hold box 5 at the proper height, tighten T-screws 80 (allen head bolts 180).

3. Position inner assemblies 44, 44 144, 144) and fasten them using T-screws 88 (or allen head bolts 188) so that thin bolts 104 will be over respective holes in lip 30. (The holes in lip 30 may be drilled at the installation site, although they are usually preformed in the lip.) Fasten box 5 to each thin bolt 104 using washer 116 and nut 120.

4. Finely adjust vertical height of box 5 in form 7 (normally so that lip 30 will rest at the top of the concrete island) using each bolt 98 (or 198) or thin bolt 104 and nut 120;

5. Adjust tilt of box 5 (normally to a level position) using each bolt 220 (second embodiment).

6. Pour concrete, let set and remove tool.

The invention is not limited to the described embodiment, as many variations will be evident to those of ordinary skill in the art. For example, instead of using metal such as construction steel for the tool, the tool also may be a rigid plastic. Accordingly, the invention is defined in the claims which follow.

What is claimed is:

1. A tool for positioning an object in a form, the tool comprising:

an elongated rod extending in a longitudinal direction;

two outer support assemblies connected to the elongated rod for movement in the longitudinal direction with respect to the rod, the two outer support assemblies each having means for supporting the elongated rod above the form; and two inner assemblies connected to the elongated rod for movement in the longitudinal direction with respect to the rod, the two inner assemblies each having means for fastening to and supporting the object in the form, wherein the two outer and inner assemblies are connected to the elongated rod by means of hollow sections of rods with inner dimensions slightly greater than outer dimensions of the elongated rod, and wherein the two outer and two inner assemblies further comprise vertical rods integrally fixed to the respective sections of rods, and wherein the means for fastening and supporting is mounted to the vertical rods of the two inner assemblies and comprises one of an angle member and a plate with a central hole and two flanking holes through it, a first bolt threaded through the central hole, the first bolt having an axial bore, a second bolt slidably disposed in the bore and extending through a further hole in the object, and a nut fastened to the second bolt, the two flanking holes each having a bolt threaded therethrough and each contacting the object for levelling the object.

2. A tool for positioning a flammable fluids or pollutant containment box in a form for laying concrete, comprising:

an elongated rod extending in a longitudinal direction;

two outer support assemblies connected to the elongate rod for movement in a longitudinal direction with respect to the rod, the two outer support assemblies each having means for supporting the rod above the form; and two inner assemblies connected to the elongated rod for movement in a longitudinal direction with respect to the rod, the two inner assemblies each having means for fastening to and supporting the containment box in the form, wherein the two outer and inner assemblies are connected to the elongated rod by means of hollow sections of rods with inner dimensions slightly greater than outer dimensions of the elongated rod, and wherein the two outer and two inner assemblies further comprise vertical rods integrally fixed to the respective sections of rods, and wherein the means for fastening and supporting is mounted to the vertical rods of the two inner assemblies and comprises one of an angle member and a plate with a central hole and two flanking holes through it, a first bolt threaded through the central hole, the first bolt having an axial bore, a second bolt slidably disposed in the bore and extending through a further hole in a lip of the containment box, and a nut fastened to the second bolt, the two flanking holes each having a bolt threaded therethrough and each contacting the object for levelling the object.

3. A tool for positioning an object in a form, in combination with the form, the combination comprising:

a form for concrete;

a single elongated rod extending in a longitudinal direction from one end of the form to an opposite end;

two outer support assemblies connected to the elongated rod for movement in the longitudinal direction with respect to the rod, the two outer support assemblies each having means for supporting the elongated rod above the form; and two inner assemblies connected to the elongated rod for movement in the longitudinal direction with respect to the rod, the two inner assemblies each having means for fastening to and supporting the object;

wherein the two outer and inner assemblies are connected to the elongated rod by hollow sections of rods having inner dimensions slightly greater than outer dimensions of the elongated rod, and wherein the means for fastening to and supporting comprises means for adjusting a position of the object in a vertical plane encompassing the longitudinal direction of the rod to adjust level by rotating a first bolt, and for adjusting the position of the object in an other vertical plane encompassing a direction transverse to the longitudinal direction by rotating a second bolt, so as to provide bi-directional adjustment of the level of the object.

4. A tool for positioning an object in a form, in combination with the form, the combination comprising:

a form for concrete;

a single elongated rod extending in a longitudinal direction from one end of the form to an opposite end;

two outer support assemblies connected to the elongated rod for movement in the longitudinal direction with respect to the rod, the two outer support assemblies each having means for supporting the elongated rod above the form; and two inner assemblies connected to the elongated rod for movement in the longitudinal direction with respect to the rod, the two inner assemblies each having means for fastening to and supporting the object;

wherein the two outer and inner assemblies are connected to the elongated rod by hollow sections of rods having inner dimensions slightly greater than outer dimensions of the elongated rod, and wherein the means for fastening to and supporting comprises first means for adjusting a position of the object in a first vertical plane encompassing the longitudinal direction of the rod to adjust level, and second means for adjusting the position of the object in a second vertical plane encompassing a direction transverse to the longitudinal direction, the first means comprising means for adjustably tilting the object in the first vertical plane, and the second means comprising means for adjustably tilting the object in the second vertical plane, so as to provide bi-directional adjustment of the level of the object.

* * * * *

UNITED STATES PATENT AND TRADEMARK OFFICE

CERTIFICATE OF CORRECTION

PATENT NO. : 5,058,854

DATED : October 22, 1991

INVENTOR(S) : Sergio M. Bravo

It is certified that error appears in the above-identified patent and that said Letters Patent is hereby corrected as shown below:

Column 2, line 54, after "FIG." insert -- 1 --.

Column 6, line 3, change "44,44 144,144)" to
-- 44,44 (144,144) --.

Column 8, line 8, change "an other" to -- another --.

Signed and Sealed this

Sixth Day of April, 1993

*Attest:*

STEPHEN G. KUNIN

*Attesting Officer*

*Acting Commissioner of Patents and Trademarks*